US006786250B2

(12) United States Patent
Stanley

(10) Patent No.: US 6,786,250 B2
(45) Date of Patent: Sep. 7, 2004

(54) FLEXIBLE DISPENSER MODULES

(75) Inventor: Dean P. Stanley, Fort Wayne, IN (US)

(73) Assignee: Tokheim Holding B.V. (NL)

( * ) Notice: Subject to any disclaimer, the term of this patent is extended or adjusted under 35 U.S.C. 154(b) by 0 days.

(21) Appl. No.: 10/435,635

(22) Filed: May 9, 2003

(65) Prior Publication Data

US 2004/0073525 A1 Apr. 15, 2004

Related U.S. Application Data

(60) Provisional application No. 60/379,963, filed on May 13, 2002.

(51) Int. Cl.[7] ..... B65B 1/04; B65B 3/04; B67C 3/02

(52) U.S. Cl. ..... 141/98; 141/387; 141/389; 141/390; 141/391; 141/392; 222/192; 137/560

(58) Field of Search ..... 141/1, 94, 98, 141/382, 387–392; 222/192; 137/560

(56) References Cited

U.S. PATENT DOCUMENTS 1,526,284 A 2/1925 Hinds
4,576,312 A 3/1986 Swick, Jr.
4,986,445 A 1/1991 Young et al.
5,163,586 A 11/1992 Zinsmeyer
5,406,484 A 4/1995 Wurzenberger
5,602,745 A 2/1997 Atchley et al.
5,651,478 A 7/1997 Tatsuno

*Primary Examiner*—Timothy L. Maust
(74) *Attorney, Agent, or Firm*—Randall J. Knuth

(57) ABSTRACT

A fuel-dispenser station which comprises one or more fuel hoses with fuel-dispenser nozzles useable to control a flow of fuel, which has been purchased from a fuel vendor, from the fuel vendor's fuel storage tank to the customer's fuel storage reservoir. The fuel-dispenser station comprises one or more hydraulics modules, fuel-hose modules, and/or head electronics modules. Each of the modules of the fuel-dispenser station constitutes a subsystem of the fuel-dispenser station and comprises a module frame-structure to which all of the other components of the module are engaged. Such a module of a fuel dispenser station can be assembled as a unit before being mounted to the fuel-dispenser station and can further be removed from the fuel-dispenser station as an assembled unit.

38 Claims, 5 Drawing Sheets

FLEXIBLE DISPENSER MODULES

CONTINUING DATA

This application hereby claims the benefit under Title 35, United States Codes § 119(e) of any U.S. application Ser. No. 60/379,963 filed May 13, 2002, and is hereby incorporated by reference.

BACKGROUND OF THE INVENTION

1. Field of the Invention

The present invention relates to fuel-dispenser stations that are provided by fuel vendors at their fueling stations and which customers may operate to transfer fuel purchased from the fuel vendor from the fuel vendor's fuel storage tank to the customer's fuel reservoir. Such fuel-dispenser stations comprise one or more fuel hoses which have fuel-dispenser nozzles on a dispensing end thereof. Each of the fuel-dispenser nozzles may be used by the customer to control the rate of dispensation of fuel to their fuel reservoir. Such fuel-dispenser stations also generally comprise a so called hydraulic system which performs various functions related to control of fuel flow and measurement of fuel flow as fuel from the fuel vendor's fuel storage tanks flows through the hydraulic system and subsequently to the fuel hoses of the fuel-dispenser station. Additionally, such fuel-dispenser stations comprise head electronics components that interact with the mechanical components of the fuel-dispenser station to control the dispensation of fuel and to provide for the customer transaction data such as price per unit for the fuel purchased, quantity of fuel purchased, and total price of fuel purchased. Many different constructions of such fuel-dispenser stations are known.

2. Description of the Related Art

Known fuel-dispenser stations as described above are constructed of hundreds of different components. Such fuel-dispenser stations generally comprise a fuel-dispenser frame structure to which most of the other components of the fuel-dispenser station are directly or indirectly mounted. In known constructions of fuel-dispenser stations, most of the components thereof are engaged to one another only through their engagement to the fuel-dispenser station frame-structure and in some cases through non-structural components such as electrical connection-components and/or fluid connection-components such as fuel conduits. Such a construction of fuel-dispenser stations, wherein most of the components thereof are structurally engaged to one another only through engagement to the fuel-dispenser station frame structure, dictates many of the processes that must be followed in designing, assembling and maintaining the fuel-dispenser station.

When designing known fuel-dispenser stations that utilize the same components in different spatial arrangements, it has been necessary to devote design time to conceive unique mounting and connection arrangements for each of the components for each fuel-dispenser station with a unique spatial arrangement of its components. Because traditional construction of fuel-dispenser stations dictates detail intensive design of different spatial arrangements of the components of fuel-dispenser stations, traditional construction of fuel-dispenser stations drives considerable design costs for new designs of fuel dispenser stations. Traditional construction of fuel-dispenser stations further dictates that the fuel-dispenser station either be assembled as a substantially complete unit and shipped in such an assembled state to the fueling station or that the components of the fuel-dispenser station be assembled together on-site at the fueling station.

Assembling the fuel-dispenser station as a unit and shipping it in assembled form to the fueling station can be costly and present various packaging and shipping challenges. Assembling the fuel-dispenser station on-site at the fueling station can be difficult for the assemblers who may be working in adverse conditions and/or may have limited resources available to them during assembly.

Traditional construction of fuel-dispenser stations also dictates that most diagnosis and repair of malfunctioning systems and subsystems of the fuel-dispenser station must also be done on-site at the fueling station where the repairer may be working in adverse conditions and/or may be working with limited resources.

SUMMARY OF THE INVENTION

According to the present invention a fuel-dispenser station is constructed of one or more hydraulic modules, fuel-hose modules, and/or head electronics modules. A hydraulics module of a fuel-dispenser station according to the present invention comprises a plurality of hydraulics components of a hydraulics system of the fuel-station. A fuel-hose module of a fuel-dispenser station according to the present invention comprises one or more fuel hoses, a fuel-dispensing nozzle for each fuel hose, and structure for supporting the fuel hoses and fuel-dispensing nozzles. A head-electronics module of a fuel-dispenser station according to the present invention comprises head electronic components of said fuel-dispenser station. Each of these types of modules comprise a module frame-structure to which all of the components of the module are directly or indirectly engaged and from which these components derive support directly or indirectly. Additionally, each of these types of modules comprises all electrical connection-components and/or mechanical connection-components necessary to electrically connect the components of the module to one another so that they may function as necessary for proper operation of the fuel-dispenser station.

All of the electrical connection-components and/or mechanical connection-components, including connection components between components of the module and connection components for connection of the components of the module to the other components of the fuel-dispenser station, are also engaged directly or indirectly to and derive support directly or indirectly from the frame structure of the module. Thus, each of the types of modules which a fuel-dispenser station according to the present invention may comprise is a self-contained subsystem of the fuel-dispenser station that may be mounted to the frame structure of the module as a unit and connected to the other components of the fuel-dispenser station thereafter.

The advantages of a fuel-dispenser station constructed in accordance with the present invention relate to the processes of designing, assembling, and maintaining such a fuel-dispenser station. The process of designing a plurality of variations of fuel-dispenser stations according to the present invention is substantially more cost effective than the process of designing a plurality of variations of fuel-dispenser stations of traditional construction. This is so, because there is less duplication of detail work when designing multiple variations of fuel-dispenser stations according to the present invention. When designing multiple variations of fuel-dispenser stations according to the present invention, one design of a hydraulics module, a fuel-hose module, and/or a head electronics module may be utilized in each different design of fuel-dispenser station. Thus, by utilizing a module that has already been designed in a new design for a fuel-dispenser station, the designer avoids the necessity to conceive the details of how the components contained in the module will be supported and how they will be connected to one another. The process of assembling a fuel-dispenser station according to the present invention may comprise a step of assembling one or more of a hydraulics module, a fuel-hose module, and/or a head-electronics module in a controlled environment such as a manufacturing facility and subsequently assembling those modules to the fuel-dispenser frame structure of the fuel-dispenser station. Such a process of assembling a fuel-dispenser station is advantageous because the assembler of the one or more modules may assemble the modules in a comfortable environment with the appropriate resources to most easily assemble the module. Assembling modules as a unit before assembling them to the fuel-dispenser station has the further advantage that the subsystem of the fuel-dispenser station, which the module constitutes, may be tested for proper operation within the controlled environment before the module is shipped for assembly to the other components of the fuel-dispenser station. A fuel-dispenser system constructed of one or more of a hydraulics module, a fuel-hose module, and/or a head electronics module further provides advantages related to the processes according to which maintenance of the fuel-dispenser station is performed. When the subsystem, which a hydraulics module, a fuel-hose module, or a head electronics module constitutes, is malfunctioning, that module may be separated, as a unit, from the fuel-dispenser station and transported to a location more favorable for diagnosis and repair of the module.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
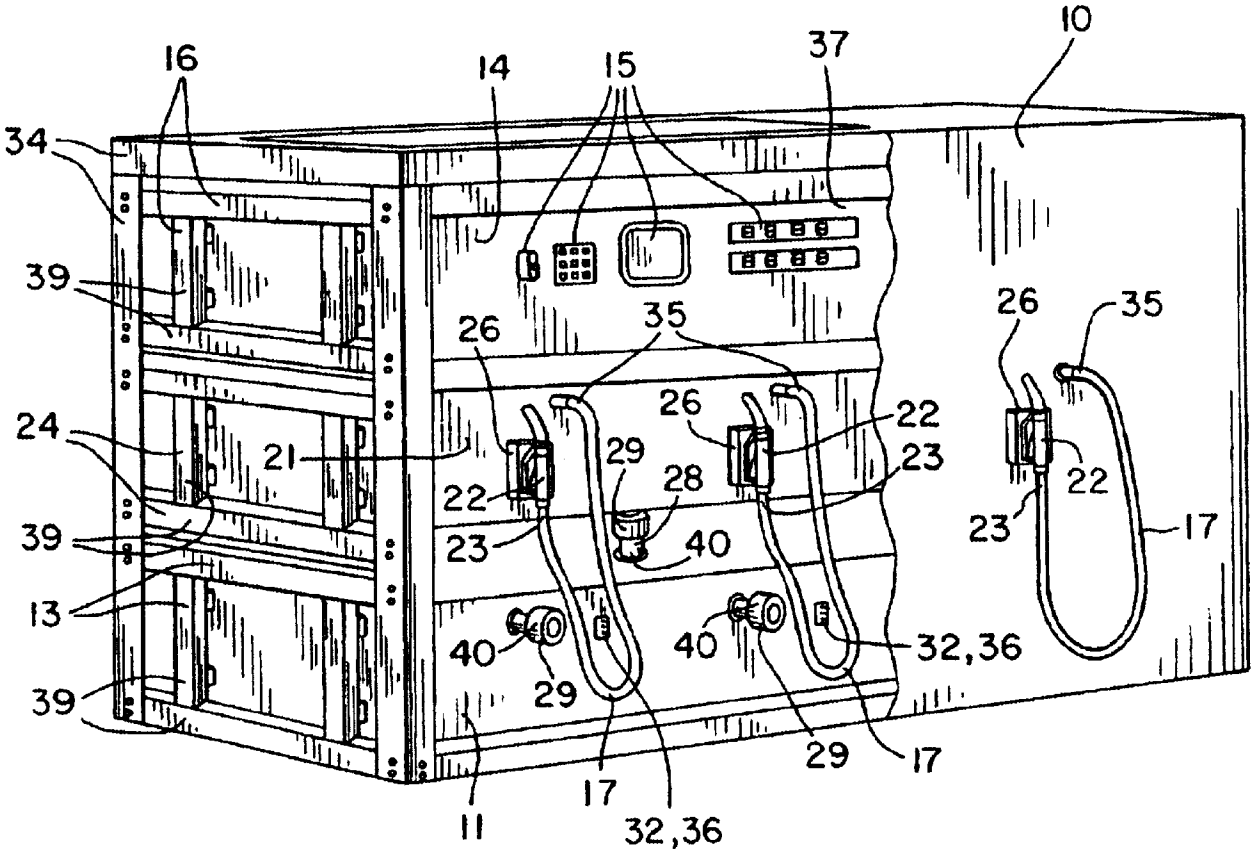
FIG. 1 is a perspective view of a fuel-dispenser station according to the present invention with part of an outer shell of the fuel-dispenser station cut-away.

Referring now to the drawings and particularly to FIG. 1, there is shown a fuel-dispenser station 10 according to the present invention. The fuel-dispenser station 10 according to the present invention includes a hydraulics system 18 through which fuel flows as it flows from a fuel-storage tank (not shown), to the fuel-dispenser station 10 and through fuel hoses 17 to a customer's fuel reservoir (not shown). A fuel-dispenser nozzle 22 is connected to a dispensing end 23 of each of the fuel hoses 17 and each fuel dispenser nozzle is useable in known ways to control the flow of fuel from the fuel hose 17 to the customer's fuel reservoir. The fuel-dispenser station 10 further includes head electronics that function to enable, among other thins, control of all aspects of operation of the fuel-dispenser station 10. The fuel-dispenser station 10 further comprises a fuel-dispenser station frame-structure 34, to which, most of the components of the fuel-dispenser station 10 are directly or indirectly engaged and from which most of the components of the fuel-dispenser station 10 derive support directly or indirectly.

The fuel-dispenser station 10 according to the present invention comprises one or more hydraulics modules 11, fuel-hose modules 21, and/or head-electronics modules 14. A hydraulics module 14 according to the present invention comprises a plurality of hydraulics components 12 of the hydraulics system 18 of the fuel-dispenser station 10. A fuel-hose module 21 of a fuel-dispenser station 10 according to the present invention comprises one or more fuel hoses 17, a fuel-dispenser nozzle 22 for each of the fuel hoses 17, and structure for supporting the fuel hoses 17 and the fuel-dispenser nozzles 22. A head-electronics module 14 of a fuel-dispenser station 10 according to the present invention includes a plurality of head-electronics components 15 of the fuel-dispenser station 10. Each type of module comprises a module frame-structure 39 to which all other components of the module are directly or indirectly engaged and from which all other components of the module derive support directly or indirectly. The module frame-structures 39 of the one or more modules of the fuel-dispenser station 10 of the present invention are, in turn, engaged to and derive support from the fuel-dispenser station frame-structure 34. The fuel-dispenser station frame-structure 34 may be a separate and distinct component from any module frame structures 39 of the one or more modules of the fuel-dispenser station 10 according to the present invention. Alternatively, one or more of the module frame structures 29 of the one or more modules of the fuel-dispenser station 10 may constitute a portion of the fuel-dispenser station frame-structure 34. Each type of module according to the present invention further comprises any and all electrical connection-components and/or mechanical connection-components necessary to connect the components of the module to one another to enable proper functioning of the fuel-dispenser station 10.

Figure 2:
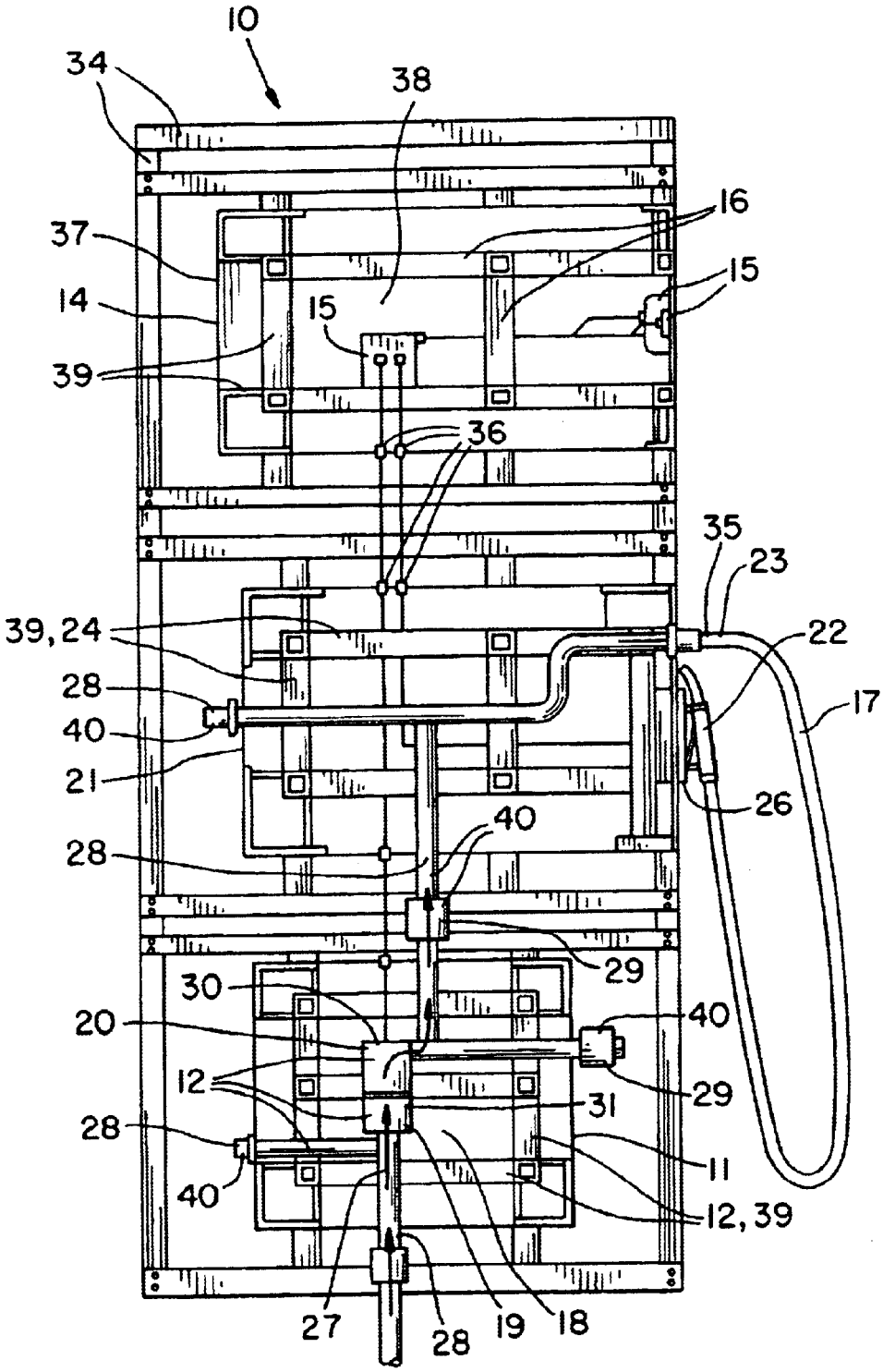
FIG. 2 is a sectional view of a fuel-dispenser station according to the present invention.
Figure 3:
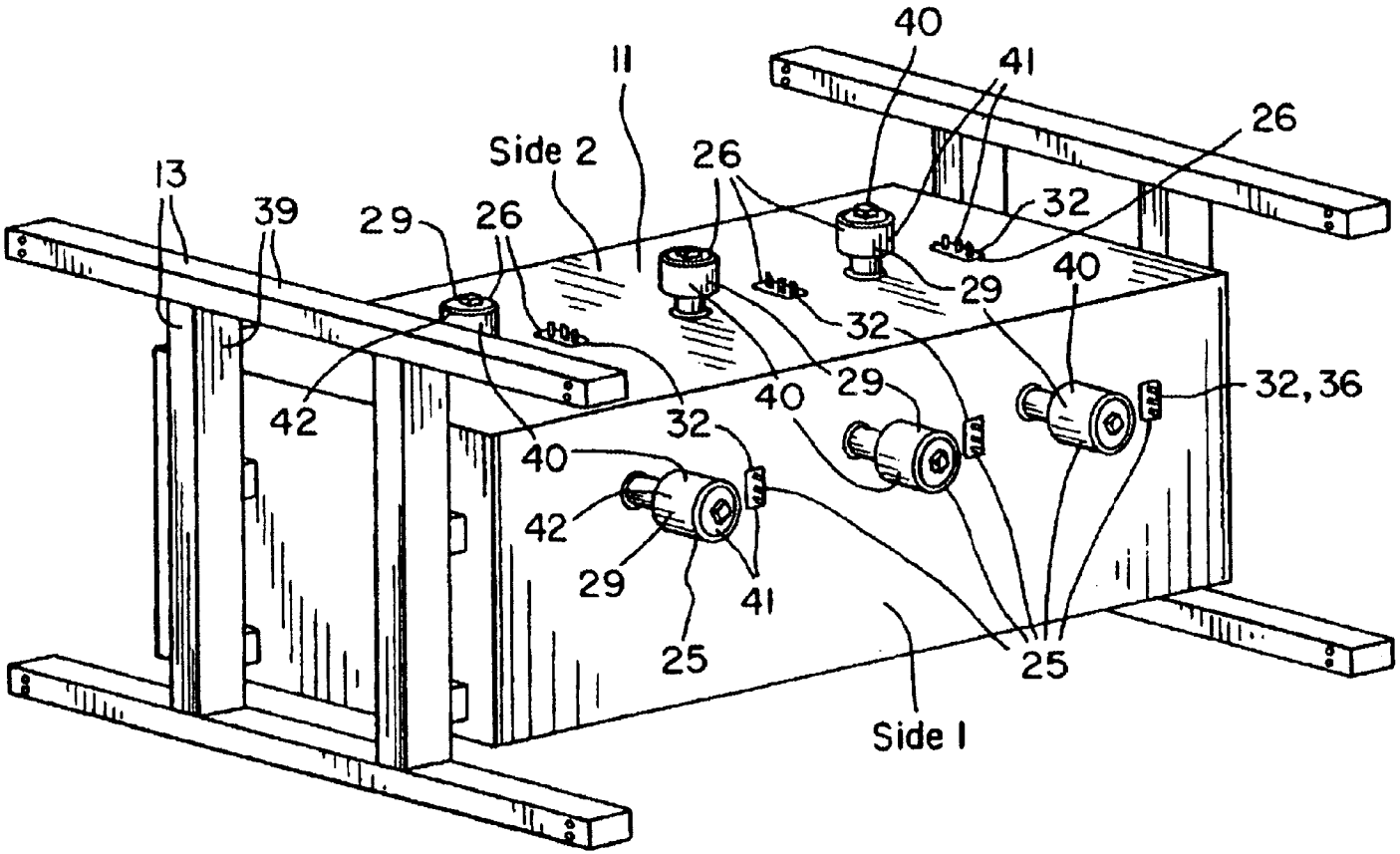
FIG. 3 is a perspective view of a hydraulics module according to the present invention.
Figure 4:
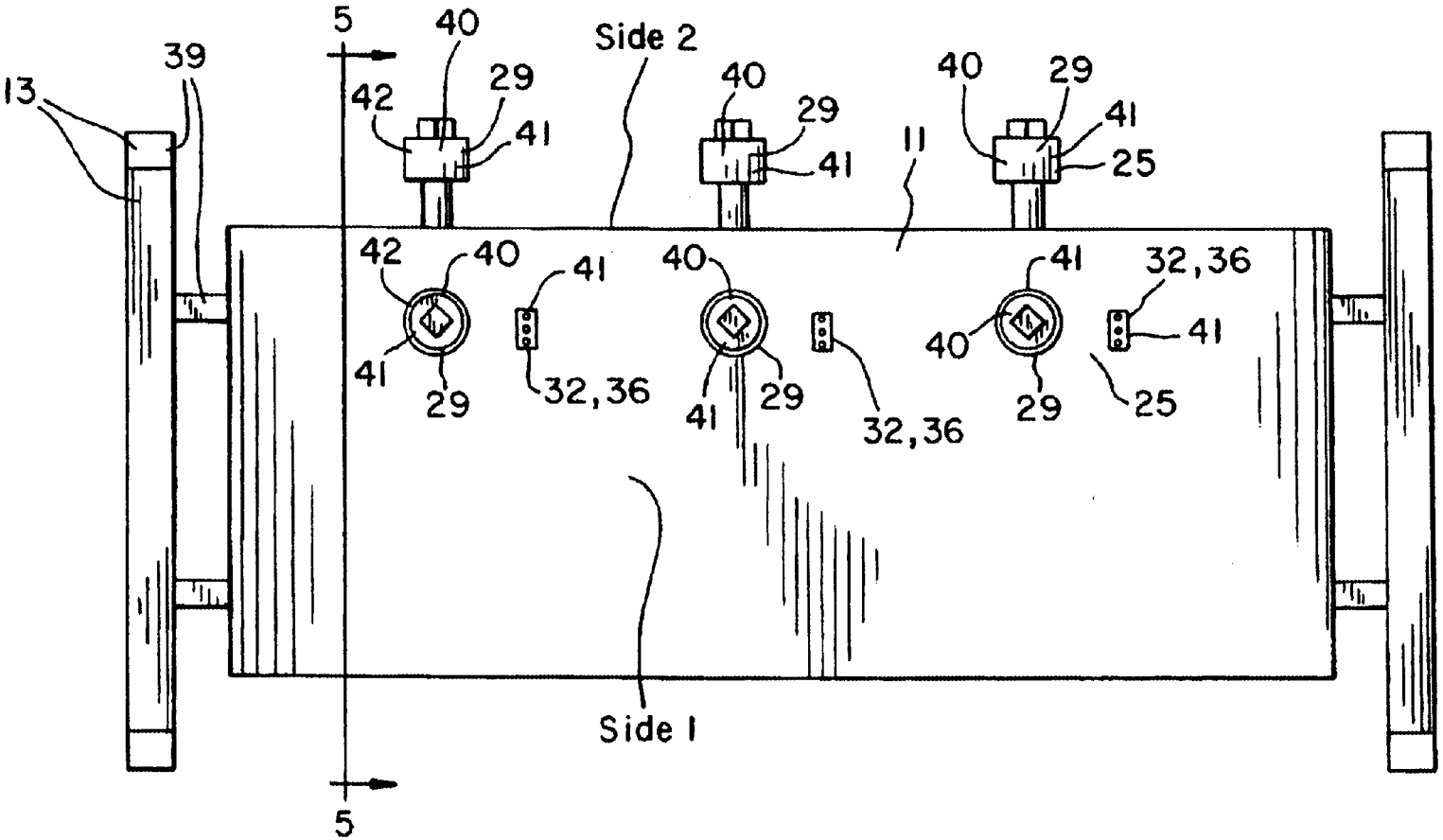
FIG. 4 is side elevational view of the hydraulics module shown in FIG. 3.
Figure 5:
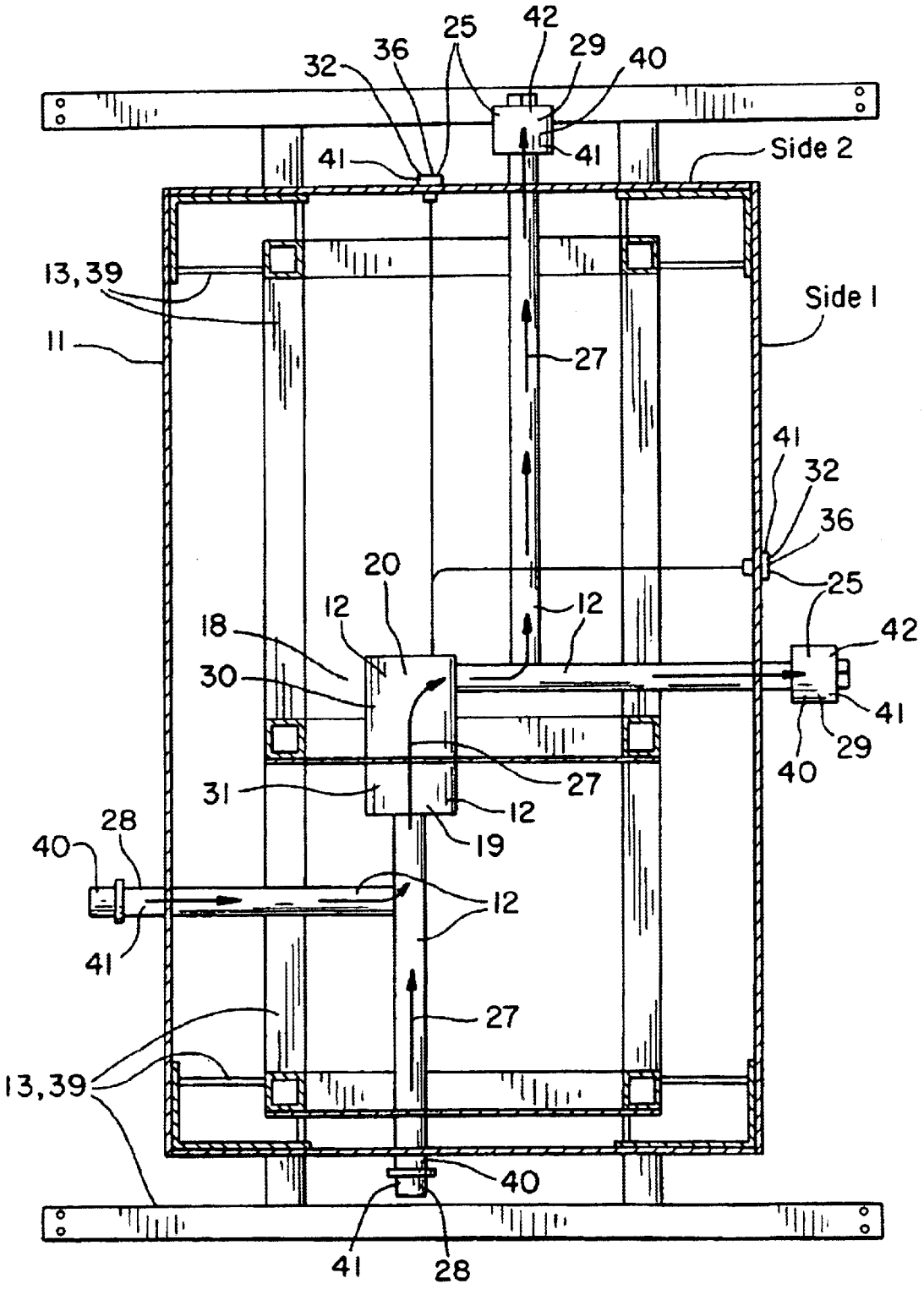
FIG. 5 is a sectional view through line 5—5 of the hydraulics module of Figure.

One embodiment of a hydraulics module 11 of a fuel-dispenser station 10 according to the present invention is shown assembled to a fuel-dispenser station 10 in FIGS. 1 and 2 and is shown separate from a fuel-dispenser station 10 in FIGS. 3, 4, and 5. A hydraulics module 11 according to the present invention comprises a hydraulics-module frame-structure 13 to which all other components of the hydraulics module 11 are directly or indirectly engaged and from which those component derive support directly or indirectly. The hydraulics-module frame-structure 13 of a hydraulics module 11 according to the present invention may be of any construction which enables mounting of the other components of the hydraulics module 11 to it, and which has sufficient strength to support the other components of the hydraulics module 11. A person of ordinary skill in the art could easily imagine any number of constructions of a hydraulics-module frame-structure which would meet the aforementioned criteria and which would be adapted for use with specific spatial arrangements of the components of the fuel-dispenser station 10. A hydraulics module 11 according to the present invention further comprises one or more pairs of an inlet connection-component 28 and an outlet connection-component 29 that are mounted to the hydraulics-module frame-structure 13. A hydraulics module 11 according to the present invention further comprises a series of hydraulics components 12 connected between each pair of an inlet connection-component 28 and an outlet connection-component 29. Each series of hydraulics components 12 connected between an inlet connection-component 28 and an outlet connection-component 29 defines a fuel-flow path 27 through which fuel may flow between the inlet connection-component 28 and the outlet connection-component 29 when the fuel-dispenser station 10 is in use. When such a hydraulics module 11 is properly mounted to a fuel-dispenser station 10 and connected to the other components thereof, the inlet connection-component 28 is in fluid communication with the fuel-storage tank (not shown) and the outlet connection-component 29 of the hydraulics module 11 is in fluid communication with the inlet end of one or more fuel hoses 17 of the fuel-dispenser station 10. Thus, fuel may flow from the fuel storage tank (not shown) to an inlet connection-component 28 of the hydraulics module 11, through a fuel-flow path defined by hydraulics components 12 connected in series between the inlet connection-component 28, and out the outlet connection-component 29 to one or more fuel hoses 17 of the fuel-dispenser station 10. In the preferred embodiment of the invention, in which the fuel-dispenser station 10 comprises a fuel-hose module 21, in addition to a hydraulics module 11, one or more of the outlet connection-components 29 of the hydraulics module 11 are connected to inlet connection-components 28 of the fuel-hose module 21, which is described in greater detail below. The hydraulics module 11 also preferably comprises any electrical connection-components 32 that are necessary to electrically connect any components of the hydraulics module 11 to the other components of the fuel-dispenser station 10. For example, the hydraulics module 11 preferably includes one or more fuel-metering devices 30 connected in series between each inlet connection-component 28 and each outlet connection-component 29 of the hydraulics module 11. Many known fuel-metering devices 30 require electrical connection to the head-electronics components 15 of the fuel-dispenser station 10 so that the head-electronics components 15 may receive electrical signals useable to determine the amount of fuel that has flowed through the fuel-metering device 30. If such a fuel-metering device 30 is employed in the hydraulics module 11, it is preferable that the hydraulics module 11 also comprises an electrical connection-component 32 for electrically connecting the fuel-metering device 30 to the head-electronics components 15 of the fuel-dispenser station 10. In fact, in the preferred embodiment of the invention, the one or more hydraulics modules 11 each comprise any and all electrical connection-components 32 and/or mechanical connection-components 40 necessary to connect the hydraulics module 11 to the other components of the fuel-dispenser station 10 and enable proper functioning of the fuel-dispenser station 10.

The hydraulics components 12 that are connected in series between each inlet connection-component 28 and each outlet connection-component 29 of the hydraulics module 11 may be any of a number of different kinds of well-known active, reactive, and/or passive hydraulics components 12 of fuel dispenser systems. Active hydraulics components 12 of the hydraulics module 11 would be components that are operable to affect the rate of flow of fuel through a fuel-flow path 27 of the hydraulics module. Examples of active hydraulics components 12 that may be connected in series between inlet connection-components 28 and outlet connection-components 29 of the hydraulics module 11 include but are not limited to, pumps, valves and blending devices. Reactive hydraulics components 12 are hydraulics components 12 that react to changes in the characteristics of fuel flow through fuel-flow paths 27 of the hydraulics module 11 and change operational state under certain conditions of fuel flow through those fuel-flow paths 27. Examples of reactive hydraulics components 12 that can be connected in series between inlet connection-components 28 and outlet connection-components 29 of the hydraulics module 11 include but are not limited to fuel-metering devices 30 and check valves. Passive hydraulics components 12 of the hydraulics module 11 and of the hydraulics system 18 of the fuel-dispenser station 10 in general are hydraulics components 12 that generally have the same operational state regardless of the characteristics of fuel flow through the fuel-flow paths of the hydraulics system 18 of the fuel-dispenser station 10. Examples of passive hydraulics components that may be connected in series between inlet connection-components 28 and outlet connection-components 29 of the hydraulics module 11 include but are not limited to connection components and conduits that connect the active and reactive components of the hydraulics module 11. In the preferred embodiment the hydraulics module 11 comprises a flow-control valve 31 and a fuel-metering device 30 connected in series between the inlet connection-component 28 and the outlet connection-component 29 of each pair of an inlet connection-component 28 and an outlet connection-component 29. Each flow-control valve 31 of the hydraulics module 11 controls the flow rate of fuel through the fuel-flow path 27 that is defined through the flow-control valve 31. Each fuel-metering device 30 measures the quantity of fuel that flows through the fuel-flow path 27 defined through the fuel-metering device 30.

A fuel-dispenser station 10 according to the present invention may comprise only one hydraulics module 11 with hydraulics components 12 that define multiple fuel-flow paths 27 through the hydraulics module 11. Alternatively, a fuel-dispenser station 10 may comprise two or more hydraulics modules 11 each of which having hydraulics components 12 that define an integer number of fuel-flow paths 27 through each hydraulics module 11. Construction of a fuel-dispenser station 10 with only one hydraulics module 11, which defines multiple fuel-flow paths 27 through itself is efficient from a materials standpoint and is also efficient relative to assembly labor. The less fuel-flow paths 27 a hydraulics module 11 defines, however, the more flexibility is afforded in designing and constructing multiple types of fuel-dispenser stations 10 which have varying numbers of fuel hoses 17. For instance, when this practice is taken to its extreme and multiple hydraulics modules 11, each of which defines only a single fuel-flow path 27, are used to construct fuel-dispenser stations 10, those fuel dispenser stations 10 can easily be designed and constructed with any number of fuel hoses 17.

A fuel-dispenser station 10 according to the present invention may have all of its hydraulics components 12 of its hydraulics system 18 contained in one or more hydraulics modules 11. Alternatively, a fuel-dispenser station may have some of its hydraulics components 12 contained in hydraulics modules 11 and others of its hydraulics components 12 otherwise engaged to the fuel-dispenser station 10. In some embodiments of the present invention, in which the fuel-dispenser station 10 comprises one or more fuel-hose modules 21, a fuel-dispenser station 10 according to the present invention may not comprise any hydraulics modules 11. In the preferred embodiment a fuel-dispenser station 10 according to the present invention has all of its active and reactive hydraulics components 12 contained in hydraulics modules 11.

According to the present invention a fuel-dispenser station 10 may comprise one or more fuel-hose modules 21. One embodiment of a fuel-hose module 21 according to the present invention is shown assembled to a fuel-dispenser station in FIGS. 1 and 2. A fuel-hose module 21 according to the present invention comprises a hose-module frame-structure 24, to which, all other components of the fuel-hose module 21 are directly or indirectly engaged and from which all other components of the fuel-hose module 21 derive support directly or indirectly. The hose-module frame-structure 24 of a fuel-hose module 21 according to the present invention may be of any construction which enables mounting of the components of the fuel-hose module 21 in the desired spatial arrangement of the design of fuel-dispenser station 10 for which the fuel-hose module 21 is constructed and which is strong enough to support the components of the fuel-hose module 21. A fuel-hose module 21 further comprises one or more fuel hoses 17 through which fuel flows when a customer operates the fuel-dispenser station 10 to dispense fuel to their fuel reservoir. A fuel-hose module 21 further comprises a fuel-dispenser nozzle 22 attached to a dispensing end 23 of each of the fuel hoses 17 of the fuel-hose module 21. The fuel-dispenser nozzles 22 of the fuel-hose module 21 may be of any well-known construction. Additionally, a fuel-hose module 21 according to the present invention comprises nozzle-hanging structure 26 which is constructed and positioned to enable hanging of the fuel-dispenser nozzles 22 upon the nozzle-hanging structure 26, when the fuel-dispenser nozzles 22 are not in use. A fuel-hose module 21 according to the present invention further comprises an inlet connection-component 28 for each of the fuel hoses 17 of the fuel-hose module 21. Each of the inlet connection-components 28 of the fuel-hose module 11 is in fluid communication with an inlet end 35 of one of the fuel hoses 17. Each inlet connection-component 28 of the fuel-hose module 21 may be directly connected to the inlet end 35 of a fuel hose 17 or it may be connected to one or more conduits or other components which are, in turn, in fluid communication with the inlet end 35 of the fuel hose 35. When a fuel-hose module 21 according to the present invention is properly assembled to a fuel-dispenser station 10 and connected to the other components thereof, the inlet connection-components 28 of the fuel-hose module 21 are connected to and in fluid communication with outlet connection-components 29 of the hydraulics system 18 of the fuel-dispenser station 10. Thus, fuel may be delivered from the outlet connection-components 29 of the hydraulics system 18 of the fuel-dispenser station 10 to the inlet connection-components 28 of the fuel-hose module 21 and subsequently to the fuel hoses 17 of the fuel-hose module 21. In the preferred embodiment of the invention, in which the fuel-dispenser station 10 comprises a fuel-hose module 21 and a hydraulics module 11, the inlet connection-components 28 of the fuel-hose module 21 are connected to the outlet connection-components 29 of the hydraulics module 11.

A fuel-hose module 21 according to the present invention may comprise any number of components not specifically listed above. Other components that a fuel-hose module 21 may comprise include but are not limited to hose retracting devices, hose partitioning structures, lighting components, fuel-dispenser station activation switches, etc. A fuel-hose module 21 according to the present invention also preferably comprises any and all electrical connection-components 32 and/or mechanical connection components 40 necessary to connect the components of the fuel-hose module 21 to the other components of the fuel-dispenser station 10 and to enable proper functioning of the fuel-dispenser station 10.

A fuel-dispenser station 10 according to the present invention may comprise only one fuel-hose module with multiple fuel hoses 17. Alternatively, a fuel-dispenser station 10 may comprise two or more fuel-hose modules 21. Construction of a fuel-dispenser station 10 with only one fuel-hose module 21, which has multiple fuel hoses 17, is efficient from a materials standpoint and is also efficient relative to assembly labor. The less fuel hoses 17 a fuel-hose module 21 comprises, however, the more flexibility is afforded in designing and constructing multiple types of fuel-dispenser stations 10 which have varying numbers of fuel hoses 17. For instance, when this practice is taken to its extreme and multiple fuel-hose modules 21, each of which has only a single fuel hose 17, are used to construct fuel-dispenser stations 10, those fuel-dispenser stations 10 can easily be designed and constructed with any number of fuel hoses 17.

A fuel-dispenser station 10 according to the present invention may have all of its fuel hoses 17 and fuel-dispenser nozzles 22 contained in one or more hydraulics modules 11. Alternatively, a fuel-dispenser station 10 may have some of its fuel hoses 17 and fuel-dispenser nozzles 22 contained in fuel-hose modules 21 and others of its fuel hoses 17 and fuel-dispenser nozzles 22 otherwise engaged to the fuel-dispenser station 10. In some embodiments of the present invention, in which the fuel-dispenser station 10 comprises one or more hydraulics modules 11, a fuel-dispenser station 10 according to the present invention may not comprise any fuel-hose modules 21. In the preferred embodiment a fuel-dispenser station 10 according to the present invention has all of its fuel hoses 17 and fuel-dispenser nozzles 22, contained in fuel-hose modules 21.

According to the present invention a fuel-dispenser station 10 may comprise a head-electronics module 14. A head-electronics module 14 according to the present invention comprises a head-electronics module frame-structure 16 to which all other components of the head-electronics module 14 are directly or indirectly engaged and from which these components derive support directly or indirectly. The construction of the head-electronics module frame-structure 16 may be any that enables mounting of the other components of the head-electronics module 14 in the desired spatial arrangement and, which is strong enough to support the other components of the head-electronics module 14. A head-electronics module 14 according to the present invention further comprises some or all of the head-electronics components 15 of a head-electronics system of the fuel-dispenser station 10. The head-electronics components 15 of the head-electronics system of the fuel-dispenser station 10 act in concert to enable control of all operation of the fuel-dispenser station 10. A head-electronics module 14, according to the present invention further comprises all connection-components necessary to connect the head-electronics components 15 of the head-electronics module 14 to one another. Head-electronics components 15 that a head-electronics module according to the present invention may comprise include but are not limited to fuel-dispenser controllers, credit card readers, customer interface devices (such as keypads), and display screens. In the preferred embodiment, the head-electronics module 14 comprises all of the head-electronics components 15 of the fuel-dispenser station 10. In the preferred embodiment, the head-electronics module 14 further comprises any and all connection components necessary to connect the head-electronics components 15 of the head-electronics module 14 to the other components of the fuel-dispenser station 10.

In the preferred embodiment the head-electronics module 14 is constructed in such a manner that the head-electronics components 15 thereof may be of ordinary and cost effective construction as contrasted to expensive, explosion-proof head-electronics components 15. In this embodiment the head-electronics module 14 comprise an outer casing 37 within which are enclosed all head-electronics components 15 of the head-electronics module 15 except for electrical connection-components 32. In this embodiment the outer casing 37 is sufficiently sealed against the penetration therethrough of fuel vapors that the space inside the outer casing 37 may be considered a non-hazardous zone. The details of how to construct such an outer casing 37 that is sealed to such a degree against penetration therethrough of fuel vapors are well known by those of ordinary skill in the art of constructing fuel-dispenser stations 10.

The hydraulics modules 11, fuel-hose modules 21, and/or head-electronics modules 14 of a fuel-dispenser station 10 according to the present invention may have any of a number of different positions relative to one another. The hydraulics module 11 may be disposed directly below the fuel-hose module 21, which may be disposed directly below the head-electronics module 14. Alternatively, the hydraulics module 11 and the fuel-hose module 21 may be disposed beside one another with the head-electronics module disposed above one or the other of the hydraulics module 11, and the fuel-hose module 21. In the preferred embodiment the modules of the fuel-dispenser station 10 are constructed in such a manner to enable easy design and construction of a number of different fuel-dispenser stations 10 with different spatial arrangements of the hydraulics module 11, the fuel-hose module 21, and the head-electronics module 14 thereof. In the preferred embodiment, as was mentioned above, each hydraulics module 11, fuel-hose module 21, and/or head-electronics module 14 comprises any and all electrical connection-components 32 and/or mechanical connection-components 40 necessary to connect the components of the modules to other components of the fuel-dispenser station 10. Additionally, in the preferred embodiment, each connection component 41 of each module is redundant with at least one other connection component 41 of the module. A connection component 41 that is redundant with respect to another connection component 41 is connected to in a same manner to a component of the module as the connection component with respect to which it is redundant. Thus, a connection component 41 of a first module may be connected to any one of a group of connection components 41 of a second module that are redundant with respect to one another and effect the same functional connection between the connection component 41 of the first module and the component of the second module to which the redundant connection components are connected. For example, FIGS. 3, 4, and 5, illustrate a hydraulics module 11 that has redundant inlet connection-components 28, and redundant outlet connection-components 29. The first outlet connection-component 42 that protrudes from side 1 of the hydraulics module 11 is redundant with respect to the first outlet connection-component 42 protruding from side 2 of the hydraulics module because they are commonly connected to and in fluid communication with an outlet side of one of the fuel-metering devices 30 of the hydraulics module 11. Thus, an inlet connection-component 28 of a fuel-hose module 21 may be connected to either one of these redundant outlet connection-components 29 and be in fluid communication with the outlet side of the fuel-metering device 30 of the hydraulics module 11. The inlet connection-components 28 of the hydraulics module 11 that are redundant with respect to one another are similarly connected to a same point of a same component of the hydraulics module. Additionally, the hydraulics module 11 shown in FIGS. 3, 4, and 5 comprises electrical connection-components 32 that are redundant with respect to one another because they are connected to a same point of a same component of the hydraulics module 11. Similar manners of construction can be utilized to provide fuel-hose modules 21 and head-electronics modules 14 with electrical connection-components 32 and/or mechanical connection-components 40 that are redundant with respect to one another. In keeping with the purpose of having connection components 41 that are redundant with respect to one another, it is preferred that each connection component 41 that is redundant with respect to other connection components 41 be disposed upon different sides of the module which comprises them. Positioning redundant connection components upon different sides of modules for fuel-dispenser stations 10 enables easy construction of fuel-dispenser stations 10 with the modules thereof in different relative positions.

In the preferred embodiment the connection components 41 of the hydraulics module 11, the fuel-hose module 21, the head-electronics module 14, which are for use in connecting the components of those modules to other components of the fuel-dispenser station 10, are arranged in connection-component arrays 25. Each of the modules shown in the figures has its connection components 41, which are for use in connecting the components of the module to other components of the fuel-dispenser station 10, arranged in connection component arrays 25. For example, the hydraulics module 11 shown in FIGS. 3, 4, and 5 has a connection-component array 25 of three outlet connection-components 29 and three electrical connection-components 32 disposed upon each of its first side and its second side. Additionally the connection component arrays 25 disposed upon the first side and the second side of the hydraulics module 11 shown in FIGS. 3, 4, and 5 are connection-component arrays 25 that are redundant with respect to one another. These connection component arrays 25 are redundant with respect to one another because the connection components 41 of the connection-component array 25 disposed upon the first side of the hydraulics module 11 are redundant with respect to the connection components 41 of the connection-component array 25 disposed upon the second side of the hydraulics module 11.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A fuel-dispenser station useable by a customer to transfer fuel, which the customer has purchased from a fuel vendor, from the fuel vendors fuel-storage tank to a fuel reservoir of the customer, said fuel-dispenser station comprising:

fuel-dispenser station frame-structure to which other components of said fuel-dispenser station are directly or indirectly engaged and from which said other components of said fuel-dispenser station derive support directly or indirectly;

a hydraulics system through which fuel is transferred between the fuel vendors fuel-storage tank and one or more fuel dispenser hoses when said fuel-dispenser station is operated;

a hydraulics module that comprises a hydraulics-module frame-structure and hydraulics components of said hydraulics system that are mounted to and supported by said hydraulics module frame structure;

wherein said hydraulics module comprises one or more pairs of an inlet connection-component and an outlet connection component which are engaged directly or indirectly to and are supported directly or indirectly by said hydraulics-module frame-structure;

wherein said inlet connection-component and said outlet connection-component of each pair of an inlet connection-component and an outlet connection-component of said hydraulics module are in fluid communication with one another through a fuel-flow path defined through a series of hydraulics components connected in series between said inlet-connection-component and said outlet connection-component;

wherein all active and reactive hydraulics components of said hydraulics system that are downstream of said inlet connection-components of said hydraulics module are connected in series between said inlet connection-component and said outlet connection-component;

wherein said hydraulics components that are connected in series between said one or more pairs of an inlet connection-component and an outlet-connection-component are engaged directly or indirectly to and derive support directly or indirectly from said hydraulics-module frame structure; and wherein said hydraulics module further comprises any and all electrical connections-components and/or mechanical connection-components necessary to connect all components of said hydraulics module to one another to enable proper functioning of said fuel-dispenser station.

2. The fuel-dispenser station of claim 1, further comprising:

head-electronics components that enable control of all aspects of operation of said fuel dispenser station;

a fuel-dispenser head-electronics module that comprises a plurality of said head-electronics components and a head-electronics-module frame-structure to which said head-electronics components of said head-electronics module are engaged and by which said head-electronics components of said head-electronics module are supported;

wherein said head-electronics module further comprises any and all electrical connections-components and/or mechanical connection-components necessary to connect all components of said head-electronics module to one another to enable proper functioning of said fuel-dispenser station; and wherein said hydraulics-module frame-structure and said head-electronics-module frame-structure are each releasably engaged to said fuel-dispenser station frame structure.

3. The fuel-dispenser station of claim 2, further comprising:

one or more fuel-hose modules each of which comprises a hose-module frame-structure;

wherein each of said fuel-hose modules comprises one or more of said fuel hoses through which fuel flows after it flows through said hydraulics system and a fuel-dispenser nozzle at a dispensing end of each of said fuel hoses of each of said fuel-hose modules;

wherein each of said fuel-hose modules comprises nozzle-hanging structure upon which each of said fuel-dispenser nozzles of said fuel-hose module may be hung when not in use;

wherein said fuel-hose, said fuel-dispenser nozzles, and said nozzle-hanging structure of each fuel-hose module are all commonly engaged to and supported by said hose-module frame structure;

wherein said fuel-hose module further comprises an inlet connection-component for each of said fuel hoses of said fuel-hose module;

wherein each of said inlet connection-components of said fuel-hose module is mounted directly or indirectly to said hose-module frame-structure, is in fluid communication with an inlet end of one of said fuel hoses and is connected to and in fluid communication with one of said outlet connection-components of said hydraulics module;

wherein said fuel-hose module further comprises any and all electrical connections-components and/or mechanical connection-components necessary to connect all components of said fuel-hose module to one another to enable proper functioning of said fuel-dispenser station; and wherein said hydraulics-module frame-structure, said head-electronics-module frame-structure, and said hose-module frame-structure are each releasably engaged to said fuel-dispenser station frame-structure.

4. The fuel-dispenser station of claim 3, wherein:

one or more of said modules of said fuel dispenser station, which modules comprise said hydraulics module(s), said head-electronics module(s), and said hose module(s), comprise(s) multiple redundant connection-component arrays each of which comprises connection components for enabling mechanical and/or electrical connection of said module to other components of said fuel-dispenser station; and wherein each connection-component array of said one or more modules that comprise multiple redundant connection-component arrays is located upon a different side of said module than are said other connection-component arrays.

5. The fuel-dispenser station of claim 4, wherein:

said one or more hydraulics modules comprise all active and reactive hydraulics components of said fuel-dispenser station.

6. The fuel-dispenser station of claim 5, wherein:

said one or more hose modules comprise all fuel hoses, all dispenser nozzles, and all nozzle-hanging structures of said fuel-dispenser station.

7. The fuel-dispenser station of claim 6, wherein:

said one or more head-electronics modules comprise all of said head-electronics components of said fuel-dispenser station.

8. The fuel-dispenser station of claim 7, wherein:

each of said hydraulics module, said fuel-hose module, and said head electronics module comprises all connection components necessary to mechanically and/or electrically connect components thereof to other components of said fuel-dispenser station; and all of said connection components of said hydraulics module, said fuel-hose module, and said electronics module are engaged directly or indirectly to and supported directly or indirectly by said hydraulics-module frame-structure, said hose-module frame structure, and said head-electronics-module frame structure respectively.

9. The fuel-dispenser station of claim 8, wherein:

said connection components of said hydraulics module, said fuel-hose module, and said head-electronics module are arranged in connection-component arrays;

each of said hydraulics module, said fuel-hose module, and said head-electronics module comprise multiple redundant connection component arrays; and each of said multiple redundant connection-component arrays is disposed upon a different side of a module which comprises it than are those connection component arrays with respect to which it is redundant.

10. The fuel-dispenser station of claim 5, wherein:

said fuel-dispenser station comprises one and only one hydraulics module which comprises all of said active and reactive hydraulics components of said fuel-dispenser station.

11. The fuel-dispenser station of claim 5, wherein:

said fuel-dispenser station comprises two or more hydraulics modules, each of which comprises an integer number of pairs of an inlet connection-component and an outlet connection-component with a series of hydraulics components connected between them;

each of said hydraulics modules comprises a hydraulics-module frame-structure separate and distinct from hydraulics-module frame-structures of each other hydraulics module; and each hydraulics-module frame-structure is releasably engaged directly or indirectly to said fuel-dispenser station frame-structure.

12. The fuel-dispenser station of claim 5, wherein:

said fuel-dispenser station comprises one and only one fuel-hose module which comprises all of said fuel hoses, fuel-dispenser nozzles, and nozzle-hanging structures of the fuel-dispenser station.

13. The fuel-dispenser station of claim 5, wherein:

said fuel-dispenser station comprises two or more fuel-hose modules each of which comprises only one fuel hose, only one fuel-dispenser nozzle, and only one nozzle-hanging structure;

each of said fuel-hose modules comprises a hose-module frame-structure which is separate and distinct from hose-module frame-structures of other fuel-hose modules; and each of said hose-module frame-structures is releasably engaged directly or indirectly to said fuel-dispenser station frame-structure.

14. The fuel-dispenser station of claim 1, wherein:

said hydraulics module comprises two or more redundant connection-component arrays, each of which comprises connection components for mechanically and/or electrically connecting said hydraulics components of said hydraulics module to other components of said fuel-dispenser station;

said connection components of said hydraulics module are directly or indirectly engaged to said hydraulics-module frame-structure and directly or indirectly derive support therefrom; and each of said redundant connection-component arrays is disposed upon a side of said hydraulics module different from connection-component arrays relative to which it is redundant.

15. The fuel-dispenser station of claim 2, wherein:

said head-electronics module comprises all head electronics components of said fuel-dispenser station;

said head-electronics module comprises an outer casing within which head-electronics components of said head-electronics module are enclosed; and said outer casing of said head electronics module is sufficiently sealed against the penetration of fuel vapors therethrough that the spaced confined by said outer casing of said head electronics module may be considered a non-hazardous zone.

16. The fuel-dispenser station of claim 1, wherein:

said hydraulics components connected in series between each of said pairs of an inlet connection-component and an outlet connection-component comprise a flow-control valve and a fuel-metering device.

17. A fuel-dispenser station useable by a customer to transfer fuel, which the customer has purchased from a fuel vendor, from the fuel vendors fuel-storage tank to a fuel reservoir of the customer, said fuel-dispenser station comprising:

fuel-dispenser station frame structure to which other components of said fuel-dispenser station are directly or indirectly engaged and from which said other components of said fuel-dispenser station derive support directly or indirectly;

a hydraulics system through which fuel flows as it is transferred from the fuel vendor's fuel-storage tank to the customer's fuel reservoir;

a fuel-hose module which comprises one or more fuel hoses, one or more fuel-dispenser nozzles, nozzle-hanging structure, and a hose-module frame structure to which said fuel hoses, said fuel-dispenser nozzles, and said nozzle-hanging structure are all directly or indirectly engaged and from which said fuel hoses, said fuel-dispenser nozzles, and said nozzle-hanging structure directly or indirectly derive support;

wherein said fuel-hose module further comprises an inlet connection-component for each of said fuel hoses of said fuel-hose module;

wherein each of said inlet connection-components of said fuel-hose module is mounted directly or indirectly to said hose-module frame-structure, is in fluid communication with an inlet end of one of said fuel hoses and is connected to and in fluid communication with an outlet connection-component of said hydraulics system and receives fuel therefrom when fuel is being transferred from the fuel vendor's fuel-storage tank to the customer's fuel reservoir;

wherein said fuel-hose module further comprises any and all electrical connections-components and/or mechanical connection-components necessary to connect all components of said fuel-hose module to one another to enable proper functioning of said fuel-dispenser station; and said hose-module frame structure is releasably engaged directly or indirectly to said fuel-dispenser station frame-structure.

18. The fuel-dispenser station of claim 17, wherein:

said fuel-hose module comprises any and all connection components necessary to mechanically and/or electrically connect all components of said fuel-hose module to other components of said fuel-dispenser station.

19. The fuel-dispenser station of claim 18, wherein:

all of said connection components of said fuel-hose module, other than connection components that connect components of said fuel hose module to one another, are arranged in multiple redundant connection-component arrays; and each of said redundant connection-component arrays is disposed upon a side of said fuel-hose module different from sides upon which connection-component arrays with respect to which it is redundant are disposed.

20. The fuel-dispenser station of claim 19, wherein:

said hydraulics system of said fuel-dispenser station comprises one or more hydraulics modules;

said hydraulics module comprises a hydraulics-module frame-structure and hydraulics components of said hydraulics system that are mounted to and supported by said hydraulics module frame structure;

said hydraulics module comprises one or more pairs of an inlet connection-component and an outlet connection component which are engaged directly or indirectly to and are supported directly or indirectly by said hydraulics-module frame-structure;

said inlet connection-component and said outlet connection-component of each pair of an inlet connection-component and an outlet connection-component of said hydraulics module are in fluid communication with one another through a fuel-flow path defined through a series of hydraulics components connected in series between said inlet-connection-component and said outlet connection-component;

all active and reactive hydraulics components of said hydraulics system that are downstream of said inlet connection-components of said hydraulics module are connected in series between said inlet connection-component and said outlet connection-component;

said hydraulics components that are connected in series between said one or more pairs of an inlet connection-component and an outlet-connection-component are engaged directly or indirectly to and derive support directly or indirectly from said hydraulics-module frame structure;

wherein said outlet connection-components of said hydraulics module are connected to and in fluid communication with said inlet connection-components of said fuel-hose module;

wherein said hydraulics module further comprises any and all electrical connections-components and/or mechanical connection-components necessary to connect all components of said hydraulics module to one another to enable proper functioning of said fuel-dispenser station; and said hydraulics module and said fuel-hose module are each releasably engaged directly or indirectly to said fuel-dispenser station frame structure.

21. The fuel-dispenser station of claim 20 wherein:

said fuel-hose module comprises all fuel hoses, fuel-dispenser nozzles, and nozzle-hanging structure of said fuel-dispenser station.

22. The fuel-dispenser station of claim 21, wherein:

said hydraulics module comprises any and all connection components necessary to mechanically and/or electrically connect any and all hydraulics components of said hydraulics module to other components of said fuel-dispenser station; and said connection components of said hydraulics module are directly or indirectly engaged to said hydraulics-module frame-structure and directly or indirectly derive support therefrom.

23. The fuel-dispenser station of claim 22, wherein:

said connection components that said hydraulics module comprises are arranged in redundant connection-component arrays; and each of said redundant connection-component arrays is disposed upon a side of said hydraulics module different from connection-component arrays relative to which it is redundant.

24. The fuel-dispenser station of claim 19, wherein:

said fuel dispenser station comprises two or more fuel-hose modules each of which comprises one and only one hose-module frame-structure, one and only one fuel hose, one and only one fuel-dispenser nozzle, and one and only one nozzle-hanging structure; and each of said hose-module frame-structures is releasably engaged directly or indirectly to said fuel-dispenser frame structure.

25. A hydraulics module for inclusion as part of a fuel-dispenser station and for connection between a fuel-storage tank and one or more fuel hoses of the fuel-dispenser station so that fuel flows from the fuel-storage tank, through the hydraulics module, and subsequently to one or more of the fuel hoses of the fuel dispenser station, when the fuel-dispenser station is operated to transfer fuel from the fuel-storage tank to a customer's fuel reservoir, said hydraulics module comprising:

a hydraulics-module frame-structure;

hydraulics components that are all directly or indirectly engaged to and derive support directly or indirectly from said hydraulics-module frame-structure;

wherein said hydraulics components comprise one or more pairs of an inlet connection-component and an outlet connection-component;

wherein said hydraulics components comprise a flow-control valve and a fuel-metering device connected in series between said inlet connection-component and said outlet connection-component of each of said pairs of an inlet connection-component and an outlet connection-component;

wherein each of said inlet connection-components is in fluid communication with its complimentary outlet connection-component through a fuel-flow path that is defined through hydraulics components, including said flow-control valve and said fuel-metering device, connected in series between said inlet connection-component and said outlet connection component; and wherein said hydraulics module further comprises any and all electrical connections-components and/or mechanical connection-components necessary to connect all components of said hydraulics module to one another to enable proper functioning of said fuel-dispenser station.

26. The hydraulics module of claim 25 for use in a fuel-dispenser station that further includes electrical components including head electronics for controlling operation of the fuel-dispenser station, wherein:

said hydraulics module further comprises one or more electrical components said hydraulics module further comprises a complete set of electrical connection-components necessary to electrically connect any and all electrical components of said hydraulics module to the electrical components of the fuel-dispenser station; and said electrical connection components of said hydraulics module are all directly or indirectly engaged to and derive support from said hydraulics-module frame-structure.

27. The hydraulics module of claim 26, wherein:

said hydraulics module comprises multiple redundant pairs of an inlet connection-component and an outlet connection-component; and each of said redundant pairs of an inlet connection-component and an outlet connection-component is connected to opposite ends of a same series of hydraulics components, which defines a fuel-flow path therethrough, as one or more other redundant pairs of an inlet connection-component and an outlet connection-component are connected to opposite ends of.

28. The hydraulics module of claim 27, wherein:

said hydraulics module comprises multiple redundant complete sets of electrical connection-components each of which is connected to all of said electrical components of said hydraulics module and can, therefore, be utilized to electrically connect any and all electrical components of said hydraulics module to the electrical components of the fuel-dispenser station.

29. The hydraulics module of claim 28, wherein:

all of said inlet connection-components, said outlet connection-components, and said electrical connection-components are arranged in connection-component arrays; and each connection-component array has a same combination of inlet connection-components, outlet connection-components, and/or electrical connection-components and a same spatial arrangement of said connection components as one or more other connection-component arrays, which are redundant with respect to said connection-component array and which are disposed upon sides of said hydraulics module different from a side of said hydraulics module upon which said connection-component array is disposed.

30. The hydraulics module of claim 25, wherein:

said hydraulics module comprises multiple redundant pairs of an inlet connection-component and an outlet connection-component; and each of said redundant pairs of an inlet connection-component and an outlet connection-component is connected to opposite ends of a same series of hydraulics components, which defines a fuel-flow path therethrough, as one or more other redundant pairs of an inlet connection-component and an outlet connection-component are connected to opposite ends of.

31. The hydraulics module of claim 30, wherein:

all of said inlet connection-components and said outlet connection-components are arranged in connection-component arrays; and each connection-component array has a same combination of inlet connection-components and/or outlet connection-components and a same spatial arrangement of said connection components as one or more other connection-component arrays, which are redundant with respect to said connection-component array and which are disposed upon sides of said hydraulics module different from a side of said hydraulics module upon which said connection-component array is disposed.

32. A fuel-hose module for inclusion in a fuel-dispenser station and for controlling flow of fuel from a hydraulics system of the fuel-dispenser station, through the fuel-hose module and into a customer's fuel reservoir, said fuel-hose module comprising:

a hose-module frame structure;

one or more fuel hoses, one or more fuel-dispenser nozzles, and one or more nozzle-hanging structures, all of which are directly or indirectly engaged to and directly or indirectly derive support from said hose-module frame structure;

wherein each of said fuel-dispenser nozzles is attached to one of said fuel hoses at a dispensing end thereof and is in fluid communication with said fuel hose to which it is attached;

wherein each of said nozzle-hanging structures is constructed and positioned such that one or more of said fuel-dispenser nozzles may be hung upon it when said fuel-dispenser nozzles are not in use; and one or more inlet connection components each of which is directly or indirectly mounted to and directly or indirectly derives support from said hose-module frame-structure and each of which is in fluid communication with an inlet end of one of said fuel hoses; and wherein said fuel-hose module further comprises any and all electrical connections-components and/or mechanical connection-components necessary to connect all components of said fuel-hose module to one another to enable proper functioning of said fuel-dispenser station.

33. The fuel-hose module of claim 32 for use in a fuel-dispenser station that further includes electrical components including head electronics for controlling operation of the fuel-dispenser station, wherein:

said fuel-hose module further comprises one or more electrical components;

said fuel-hose module further comprises a complete set of electrical connection-components necessary to electrically connect any and all electrical components of said fuel-hose module to the electrical components of the fuel-dispenser station; and said electrical connection components of said fuel-hose module are all directly or indirectly engaged to and derive support from said hose-module frame-structure.

34. The fuel-hose module of claim 33, wherein:

said fuel-hose module comprises multiple redundant inlet connection-components; and each of said redundant inlet connection-components is in fluid communication with a same inlet end of a fuel hose of said fuel-hose module as are one or more other redundant inlet connection-components.

35. The fuel-hose module of claim 34, wherein:

said fuel-hose module comprises multiple redundant complete sets of electrical connection-components each of which is connected to all of said electrical components of said fuel-hose module and can, therefore, be utilized to electrically connect any and all electrical components of said fuel-hose module to the electrical components of the fuel-dispenser station.

36. The fuel-hose module of claim 35, wherein:

all of said inlet connection-components and said electrical connection-components are arranged in connection-component arrays; and each connection-component array has a same combination of inlet connection-components and/or electrical connection-components and a same spatial arrangement of said connection components as one or more other connection-component arrays, which are redundant with respect to said connection-component array and which are disposed upon sides of said fuel-hose module different from a side of said hydraulics module upon which said connection-component array is disposed.

37. The fuel-hose module of claim 32, wherein:

said fuel-hose module comprises multiple redundant inlet connection-components; and each of said redundant inlet connection-components is in fluid communication with a same inlet end of a fuel hose of said fuel-hose module as are one or more other redundant inlet connection-components.

38. The fuel-hose module of claim 37, wherein:

all of said inlet connection-components are arranged in connection-component arrays; and each connection-component array has a same combination of inlet connection-components and a same spatial arrangement of said connection components as one or more other connection-component arrays, which are redundant with respect to said connection-component array and which are disposed upon sides of said fuel-hose module different from a side of said hydraulics module upon which said connection-component array is disposed.

* * * * *